US007950451B2

(12) United States Patent
Alberty

(10) Patent No.: US 7,950,451 B2
(45) Date of Patent: May 31, 2011

(54) ANNULUS MUD FLOW RATE MEASUREMENT WHILE DRILLING AND USE THEREOF TO DETECT WELL DYSFUNCTION

(75) Inventor: Mark W Alberty, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 251 days.

(21) Appl. No.: 12/421,849

(22) Filed: Apr. 10, 2009

(65) Prior Publication Data

US 2010/0258303 A1 Oct. 14, 2010

(51) Int. Cl.
*E21B 47/18* (2006.01)
*G01F 1/00* (2006.01)

(52) U.S. Cl. ..... 166/250.01; 166/177.2; 175/48; 73/152.21

(58) Field of Classification Search ..... 166/250.01, 166/66, 177.1, 177.2; 175/40, 48; 73/152.18, 73/152.19, 152.21, 152.29, 152.33, 152.34, 73/152.35, 152.43, 861.25; 702/6, 48; 181/102; 367/25–32

See application file for complete search history.

(56) References Cited

U.S. PATENT DOCUMENTS

| | | | | |
|---|---|---|---|---|
| 3,835,953 A | | 9/1974 | Summers | |
| 4,442,011 A | | 4/1984 | Thaler et al. | |
| 4,447,338 A | | 5/1984 | Lundberg et al. | |
| 4,527,425 A | | 7/1985 | Stockton | |
| 4,532,812 A | | 8/1985 | Birchak | |
| 4,661,933 A | | 4/1987 | Seeman et al. | |
| 4,665,511 A | | 5/1987 | Rodney et al. | |
| 4,899,112 A | | 2/1990 | Clark et al. | |
| 4,905,203 A | * | 2/1990 | Sims et al. | 340/854.9 |
| 4,947,683 A | * | 8/1990 | Minear et al. | 73/152.32 |
| 4,979,112 A | | 12/1990 | Ketcham | |
| 5,091,644 A | | 2/1992 | Minette | |
| 5,130,950 A | | 7/1992 | Orban et al. | |
| 5,341,345 A | | 8/1994 | Warner et al. | |
| 5,354,956 A | | 10/1994 | Orban et al. | |
| 5,387,767 A | | 2/1995 | Aron et al. | |
| RE34,975 E | * | 6/1995 | Orban et al. | 367/34 |
| 5,430,259 A | | 7/1995 | Warner | |

(Continued)

FOREIGN PATENT DOCUMENTS

CA 2009977 8/1991

(Continued)

OTHER PUBLICATIONS

Orban, "New Ultrasonic Caliper for MWD Operations", Mar. 11, 1991, pp. 439-448, SPE/IADC 21947.

(Continued)

*Primary Examiner* — Kenneth Thompson

(74) *Attorney, Agent, or Firm* — Jeffrey L. Wendt; John L. Wood

(57) ABSTRACT

Methods and apparatus are described that combine a measurement of the physical velocity of material within the annulus of a well between the drill pipe and the wall of the well with a measurement of the area of the flow as determined from a measurement of distance between the drill pipe and the wall of the hole to determine the actual material volumetric flow rate. Changes in volumetric flow rate at one or more points along the well can be used to determine the occurrence and location of well dysfunctions. This knowledge can then be used to make decisions about treating well dysfunctions which will lead to more efficient use of drilling rig time.

22 Claims, 8 Drawing Sheets

U.S. PATENT DOCUMENTS

| | | | | |
|---|---|---|---|---|
| 5,469,736 | A | 11/1995 | Moake | |
| 5,519,668 | A | 5/1996 | Montaron | |
| 5,638,337 | A | 6/1997 | Priest | |
| 5,737,277 | A | 4/1998 | Priest | |
| 5,900,733 | A | 5/1999 | Wu et al. | |
| 5,906,966 | A | 5/1999 | Thaler et al. | |
| 5,987,385 | A | 11/1999 | Varsamis et al. | |
| 6,285,026 | B1 * | 9/2001 | Evans et al. | 250/269.4 |
| 6,378,357 | B1 | 4/2002 | Han et al. | |
| 6,513,385 | B1 | 2/2003 | Han et al. | |
| 6,618,322 | B1 | 9/2003 | Georgi | |
| 6,658,944 | B2 | 12/2003 | Melnikov et al. | |
| 6,672,163 | B2 | 1/2004 | Han et al. | |
| 6,691,584 | B2 | 2/2004 | Gysling et al. | |
| 6,725,162 | B2 | 4/2004 | Edwards et al. | |
| 6,817,229 | B2 | 11/2004 | Han et al. | |
| 6,829,947 | B2 | 12/2004 | Han et al. | |
| 6,891,777 | B2 | 5/2005 | Pabon et al. | |
| 6,938,458 | B2 | 9/2005 | Han et al. | |
| 7,007,752 | B2 | 3/2006 | Reddy et al. | |
| 7,128,148 | B2 | 10/2006 | Eoff et al. | |
| 7,260,477 | B2 | 8/2007 | Haugland | |
| 7,418,865 | B2 * | 9/2008 | Griffiths et al. | 73/597 |
| 2003/0114987 | A1 | 6/2003 | Edwards et al. | |
| 2004/0095847 | A1 | 5/2004 | Hassan et al. | |
| 2005/0259512 | A1 | 11/2005 | Mandal | |
| 2006/0180754 | A1 * | 8/2006 | Edwards et al. | 250/269.3 |
| 2006/0254350 | A1 * | 11/2006 | Wraight | 73/152.14 |
| 2007/0151762 | A1 | 7/2007 | Reitsma | |
| 2009/0043509 | A1 | 2/2009 | Madigan | |

FOREIGN PATENT DOCUMENTS

| | | | |
|---|---|---|---|
| GB | 2187354 | A | 9/1987 |
| GB | 2399111 | A | 9/2004 |
| WO | WO 2009/029860 | A1 | 3/2009 |
| WO | WO 2009/032729 | A1 | 3/2009 |

OTHER PUBLICATIONS

Moake et al, "Standoff and Caliper Measurements While Drilling Using a New Formation-Evaluation Tool With Three Ultrasonic Transducers", Jun. 1995, pp. 104-111, 199SPE 26494.

Maranuk, "Development of an MWD Hole Caliper for Drilling and Formation Evaluation Applications", Oct. 5, 1997, pp. 1-14, SPE 38585.

Minette et al, "Utilizing Acoustic Standoff Measurements to Improve the Accuracy of Density and Neutron Measurements", Oct. 3, 1999, pp. 1-14, SPE 56447.

Maeso, "Hole Shape from Ultrasonic Calipers and Density While Drilling—A Tool for Drillers", Sep. 30, 2001, pp. 1-7, SPE 71395.

Ortenzi, "An Integrated Caliper from Neutron, Density, and Ultrasonic Azimuthal LWD Data", Sep. 29, 2002, pp. 1-9, SPE 77479.

Butt et al, "Borehole Shape Characterization With Azimuthal LWD Measurements: Evaluation, Applications, and Limitations", Oct. 24, 2007, pp. 1-12, SPE/IADC 108272.

Zemanek et al, "The Operational Characteristics of A 250 kHz Focused Borehole Imaging Device", Jun. 24, 1990, pp. 1-19, SPWLA 1990 Paper I.

Priest, "Computing Borehole Geometry and Related Parameters From Acoustic Caliper Data", Jun. 15, 1997, pp. 1-12, SPWLA 1997 paper G.

Althoff et al, "MWD Ultrasonic Caliper Advanced Detection Techniques", May 26, 1998, pp. 1-14, SPWLA 1998 paper III.

PCT International Search Report dated Sep. 21, 2010 for PCT/US2010/027084 filed Mar. 12, 2010, 3 pages.

PCT written opinion dated Sep. 21, 2010 of the International Search Report for PCT/US2010/027084, 5 pages.

* cited by examiner

ANNULUS MUD FLOW RATE MEASUREMENT WHILE DRILLING AND USE THEREOF TO DETECT WELL DYSFUNCTION

BACKGROUND INFORMATION

1. Technical Field

The present disclosure relates in general to methods of drilling wellbores, for example, but not limited to, wellbores for producing hydrocarbons from subterranean formations, and more particularly to methods of measuring annulus drilling mud flow rate, either during drilling of a wellbore or during periods of fluid flow only.

2. Background Art

Much work has been done in the industry over the past several decades to measure the rate of flow of fluids within the annulus of a well. Some workers in the field (see for example U.S. Pat. Nos. 6,938,458; 6,672,163; 6,817,229; 6,829,947; and 6,378,357, (Han, et al., assigned to Halliburton)) have claimed that a change in annular mud velocity will occur at the point where lost circulation is occurring. However, these references do not disclose computing volumetric flowrate of mud in the annulus, rather the patents focus on measuring axial, radial, and tangential velocities of the mud to determine if a kick has occurred (potentially dangerous situation where formation fluids flow into the well displacing the mud and altering the hydrostatic pressure which the mud creates to combat flow into the well). Other work has focused on identifying a kick by monitoring flow rates. See for example U.S. Pat. No. 4,527,425, Stockton, who discusses using Doppler Effect to measure changes in ratio of incoming to output mud flow rate. The occurrence of a change in this ratio above a preselected value will trigger an alarm indicative of the commencement of either a rapid influx of fluids from the formation into the mud stream (blow-out) or a rapid outflow of mud into the formation (lost circulation). Stockton does not, however, discuss measuring volumetric flow rate of the mud, only "flow rate", which Stockton defines as the rate of drilling fluid flow toward (or away from) the drill bit as a function of time. In fact, Stockton teaches to avoid the necessity of making substantial and complicated calculations to compensate for riser pipe volume variations (for example as would be necessary when the measurement is made near the surface in telescoping riser pipes) where the mud flow enters and leaves the riser pipe.

Various apparatus and methods are described in these references for obtaining the information. For example, the '163 patent mentions that by operating transducers at multiple frequencies, fewer transducers are needed to generate frequency dependence data. For example, a system might include a "1 MHz transducer" operated at 1 MHz and 3 MHz and a "9 MHz transducer" operated at 9 MHz and 27 MHz. The '163 patent also explains that speed of sound in the fluid can be calculated by measuring the time of flight of the pulse over the known distance between a transmitter and receiver. The receiver may also be used to determine the attenuation coefficient of the fluid, preferably at multiple frequencies (including third harmonics), by measuring the decay of multiple reflected signals, or comparing the transmitted signals to those of a fluid with known attenuation coefficient. As explained in the '357 patent, apparatus may use ultrasonic signals to measure Theological properties of a fluid flow such as, e.g., the consistency index K, the flow behavior index n', the yield stress, or other parameters of any given model for shear rate dependent viscosity. In one described method embodiment, the method includes: (a) transmitting an acoustic signal into the fluid flow; (b) receiving acoustic reflections from acoustic reflectors entrained in the fluid flow; (c) determining a Doppler shift of the acoustic reflections in a set of time windows corresponding to a set of desired sampling regions in the fluid flow; and (d) analyzing the Doppler shifts associated with the set of sampling regions to determine one or more Theological properties of the fluid flow. As is known, the frequency shift caused by motion of the fluid is proportional to the velocity of the fluid, and this allows the construction of a velocity profile of the fluid flow stream.

Despite these efforts, it has become evident that the measurement of mud velocity will work to recognize lost circulation or influx events only if the hole is constant diameter, the pipe is in a consistent position within the well, and the detectors are consistently aimed into common hole sectors. However, the realistic situation in wells causes these limitations to lead to misleading conclusions on the root cause, location, and appropriate treatment, and cost well operators considerable expense. Drill pipe is not normally centralized above the bottom hole assembly. Excentralization of the drillpipe will lead to variations in the annular velocity around the pipe. Detectors aimed in different radial directions will detect different velocities. As recognized by Priest, "Computing Borehole (BH) Geometry and Related Parameters From Acoustic Caliper Data," SPWLA 1997 G, borehole eccentricity, major and minor diameters, elliptical orientation, eccentering radius, and "direction" (position of tool relative to center of borehole) are important considerations. Priest describes use of an elliptical model of the BH to correct acoustic travel times and "radius images", which can be generated from the travel times. Using the "eccentering data" it is possible to construct a "centered" radius image (i.e., image that would have been obtained had the acoustic transmitter been centered). A rotating acoustic sensor is disclosed. There is, however, no disclosure of using caliper to calculate local mud flow rate at points in the wellbore.

Zemanek et al., "The Operational Characteristics of a 250 KHz Focused Borehole Imaging Device", SPWLA 1990, presents experimental data on properties of oil-based muds (OBM) obtained at different temperatures and pressures, and forms a nomograph defining the radial operating range of a particular acoustic instrument in these muds. The method and apparatus described (termed a "circumferential borehole imaging log" by the authors) employs two concave acoustic transducers having different focal points that rotate through 360° to obtain time of flight measurements. A separate mud flow velocity transducer is mounted in a cavity open to the borehole. Together they allow caliper to be determined by the equation caliper=velocity×time. However, there does not appear to be discussion of calculation of local, temperature and pressure corrected mud flow rate from an acoustic caliper and velocity of the mud measured acoustically. Rather, the authors focus on determining the limitations of the device in OBMs. Importantly, in discussing FIGS. 5A and 5B, they conclude that "acoustic attenuation" in an 11 ppg OBM is "a complicated function of temperature and pressure". For a 15 ppg OBM it is "even more complicated." (This does not even take into consideration gas, rock cuttings, and other material in the OBM.) In short, their statements and figures indicate that acoustic measurements in these muds may be "unpredictable" due to the unpredictable nature of acoustic attenuation. This "unpredictability" increases as density of the mud increases. (On the other hand, acoustic velocity in OBM seems quite predictable as a function of temperature (T) and pressure (P)—see FIGS. 4A and 4B).

Several SPE papers discuss how acoustic attenuation of muds and mud acoustic velocity depend on many parameters.

For example, Maranuk, in SPE 38585 (1997), discloses that acoustic velocity in mud depends on mud type, density, salinity, T, P, amount of gas and solids in the mud, and discloses a semi-empirical method whereby a dataset of these changes is produced, allowing "on-the-fly" corrections.

It would be advantageous if caliper and fluid velocity measurements could be combined to determine the actual flow rate in the annulus past a point in a well. This would allow integration of the fluid velocity as a function of the hole size around the well to account for pipe position. This would provide true flow rate which then could be used to reliably find a point of lost circulation or a well fluid influx which would then result in the correct diagnosis of the root cause, selection of the appropriate treatment and placement of that treatment where the problem has developed. The methods and apparatus of the present disclosure are directed to these needs.

SUMMARY

In accordance with the present disclosure, it has now been determined that caliper and fluid velocity measurements can be combined to determine the actual flow rate in the annulus past a point in a well, allowing integration of the fluid velocity as a function of the hole size around the well to account for pipe position. Methods and apparatus described herein provide true flow rate which may then be used to reliably find a point of lost circulation, a well fluid influx, or other well dysfunction, which then allows for correct diagnosis of the root cause, selection of the appropriate treatment and placement of that treatment where the problem has developed in the well. As used herein the phrase "flow rate" means volumetric flow rate (volume/time) of all material flowing past a particular point in a well. "Caliper" means the shortest distance from the drill pipe outer diameter to the wellbore wall in a plane substantially perpendicular to the drill pipe. "Standoff", a term frequently used in this area, means the shortest distance between a measuring device (or a component thereof) and the wellbore wall in a plane substantially perpendicular to the drill pipe. "During drilling" means an action is being performed involving a transformation of a subterranean well to a different state. This transformation may be, for example, but not limited to, transformation of solid rock to granular rock while the well is actually being drilled with a drill pipe, a drill bit attached to the drill pipe, and a flowing drilling mud. In another example, if actual drilling must be interrupted due to one or more well dysfunctions, such as lost circulation, well fluid influx, cuttings beds, fault movement, hole cleaning effectiveness, well bore washouts, or other well dysfunction, the transformation of the subterranean well to a different state may involve one or more well interventions to remediate those events prior to allowing actual drilling to continue, to safely circulate and continue to convert solid rock to granular rock.

A first aspect of the disclosure is a method of determining volumetric flow rate of material (which may comprise drilling mud, chemicals, rocks, and the like) in an annulus past one or more points in a well, the method comprising:

a) measuring caliper or standoff distance in a plurality of segments in a cross-section of a wellbore substantially perpendicular to a drill pipe during drilling;
b) measuring physical velocity of material in the plurality of segments during drilling;
c) computing volumetric flow rate of the material through each segment using the caliper or standoff distances and velocities; and
d) summing or integrating the volumetric flow rates to determine a total volumetric flow rate past one or more points in the well.

Exemplary methods of this disclosure use the determined total volumetric flow rate to locate a point or points of dysfunction in the well. Further methods in accordance with this disclosure use the information on the point or points of well dysfunction to diagnose root cause of the well dysfunction. In yet further exemplary embodiments, once the root cause of the well dysfunction is diagnosed, certain methods of this disclosure comprise selecting an appropriate well treatment, and placing the well treatment where the well dysfunction has developed in the well. In certain methods of this disclosure, all steps may occur during drilling, but this is not necessarily so. For example, the "computing" and "summing" steps may occur at some later time, after the measuring steps. Even if all steps occur during drilling, the steps may or may not occur at the same time. In certain embodiments, the measurements of caliper or standoff, and/or physical velocity of the mud may be made at a single point or distributed at a plurality of points along the drill pipe. Since flow will vary around the well as a result of excentralization of the drill pipe and/or gravity effects upon entrained solids in deviated wells, dividing up the well annulus into segments allows characterization of the flow velocity around the well. In certain embodiments, measuring velocity of sound in the mud in or substantially near at least a substantial number of the segments using a time of flight measurement between two points separated by a known distance may be used to improve the distance measurements, the velocity measurements, or both.

Measurement of caliper is not limited to acoustic methods. The hole size might also be measured using mechanical, electromagnetic, gamma, or rotational density methods. There will undoubtedly be other methods as well. Caliper or standoff may be measured using any caliper or standoff measuring techniques which are already described in the literature and understood by those in the art. For example, one common method used is the acoustic pulse echo technique described by Zemanek in his 1990 SPWLA paper, referred to in the Background. The Doppler measurement described in U.S. Pat. Nos. 6,938,458; 6,672,163; 6,817,229; 6,829,947; and 6,378,357, (Han, et al., assigned to Halliburton), all of which are incorporated herein by reference, may also be used, or a sonar method such as described by Gysling in his array of patents, especially U.S. Pat. No. 6,691,584, incorporated herein by reference. The velocity of sound measurement may be used to more accurately calculate the distance from a pulse echo measurement as may have been done in step (a), and may also be used to improve an acoustic physical mud velocity measurement in step (b), although the physical velocity of the mud may be measured by methods other than acoustic. Time of flight would be one way to measure the physical velocity of the mud. Physical velocity of the mud could also be measured using Doppler or sonar methods, or mechanical or neutron activation or any other number of other methods to measure physical velocity.

U.S. Pat. No. 6,725,162 summarizes various electromagnetic caliper measurement techniques, such as U.S. Pat. No. 4,899,112, which describes a technique for determining a borehole caliper by comparing phase differences and attenuation levels from electromagnetic measurements. U.S. Pat. No. 5,900,733 discloses a technique for determining borehole diameters by examining the phase shift, phase average, and attenuation of signals from multiple transmitter and receiver locations via electromagnetic wave propagation. GB 2187354 A and U.S. Pat. No. 5,519,668 also describe while-drilling methods for determining a borehole size using electromagnetic signals. U.S. Pat. No. 5,091,644 describes a method for obtaining a borehole size measurement as a by-product of a rotational density measurement while drilling. U.S. Pat. No. 6,285,026 describes a LWD technique for determining the borehole diameter through neutron porosity measurements. The disclosure of the patents in this paragraph are incorporated herein by reference.

In certain embodiments, for distance measurements performed acoustically, the method further comprises measuring temperature and annular fluid pressure in each segment, and calculating temperature- and pressure-corrected caliper or standoff using the measured temperature and annular fluid pressure in each segment. In embodiments wherein the velocities are measured acoustically, these corrections may also be applied to some or all of the physical velocity measurements. In other embodiments, the method comprises using the determined volumetric flow rate to reliably locate a point of lost circulation, a well fluid influx, or other dysfunction in the well. In yet other methods, the information on location of well dysfunction may be used to diagnose the root cause of the well dysfunction. In still other methods, once the root cause of the well dysfunction is diagnosed, the method comprises selecting an appropriate treatment, and placing a well treatment where the dysfunction has developed in the well.

Another aspect of the invention is an apparatus for determining flow rate of material at one or more points downhole in a wellbore annulus, comprising:

a) one or more sensors for measuring a plurality of distances between a drill pipe and borehole wall (preferably in a plane substantially perpendicular to the drillpipe) in a plurality of annular segments;
b) a sensor for measuring a plurality of physical velocities of material in the plurality of annular segments;
c) a computing device for computing a plurality of flow rates using the plurality of distances and the plurality of physical velocities; and
d) a summing or integrating device for summing the plurality of flow rates to create a total volumetric flow rate of material past the one or more points in the annulus.

The methods and apparatus described herein may provide other benefits, and the methods for obtaining the distance and velocity measurements in the annulus are not limited to the methods and apparatus noted; other methods and apparatus may be employed. Certain embodiments may include a sensor for measuring the velocity of sound in the mud near at least some of the sensors using a time of flight measurement between one or more transmitter/receiver pairs. Certain other embodiments may include temperature and pressure measuring sensors in the segments for measuring temperature and pressure in the segments and using the temperatures and pressures to correct acoustic measurements.

These and other features of the methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1:
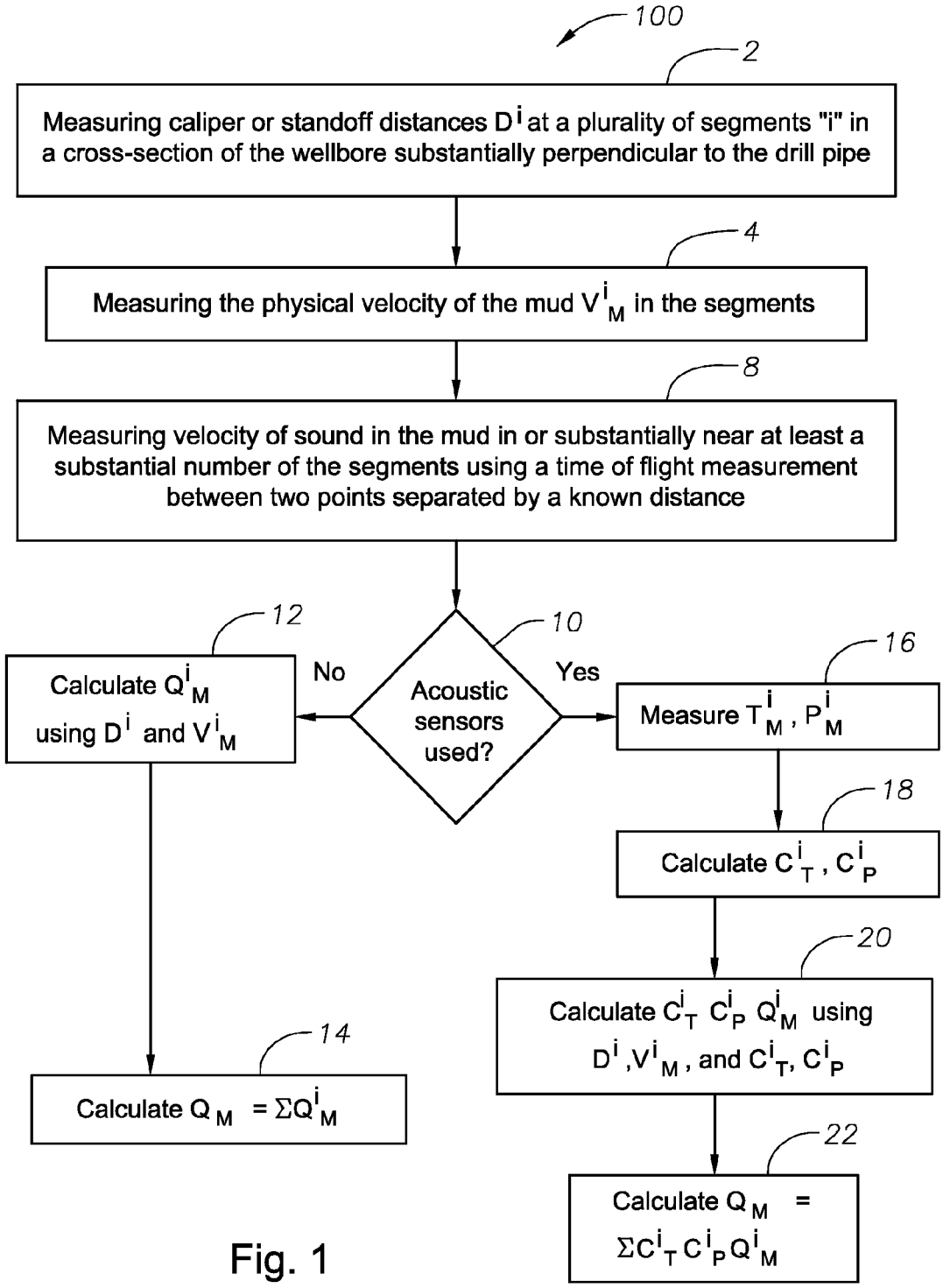
FIGS. 1-3 illustrate three method embodiments of the present disclosure in flowchart form.

It is to be noted, however, that the appended drawings are not to scale and illustrate only typical embodiments of this disclosure, and are therefore not to be considered limiting of its scope, for the disclosure may admit to other equally effective embodiments. Identical reference numerals are used throughout the several views for like or similar elements.

DETAILED DESCRIPTION

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

As noted above, it has now been determined that caliper and fluid velocity measurements can be combined to determine the actual volumetric flow rate in the annulus past a point in a well, allowing integration of the fluid velocity as a function of the hole size around the well to account for pipe position. Methods and apparatus described herein provide true volumetric flow rate during drilling which may then be used to reliably find a point of lost circulation, a well fluid influx, or other well dysfunction, which then allows for correct diagnosis of the root cause, selection of the appropriate treatment and placement of that treatment where the problem has developed in the well. Methods and apparatus of the invention are applicable to both on-shore (land-based) and offshore (subsea-based) drilling.

Figure 2:
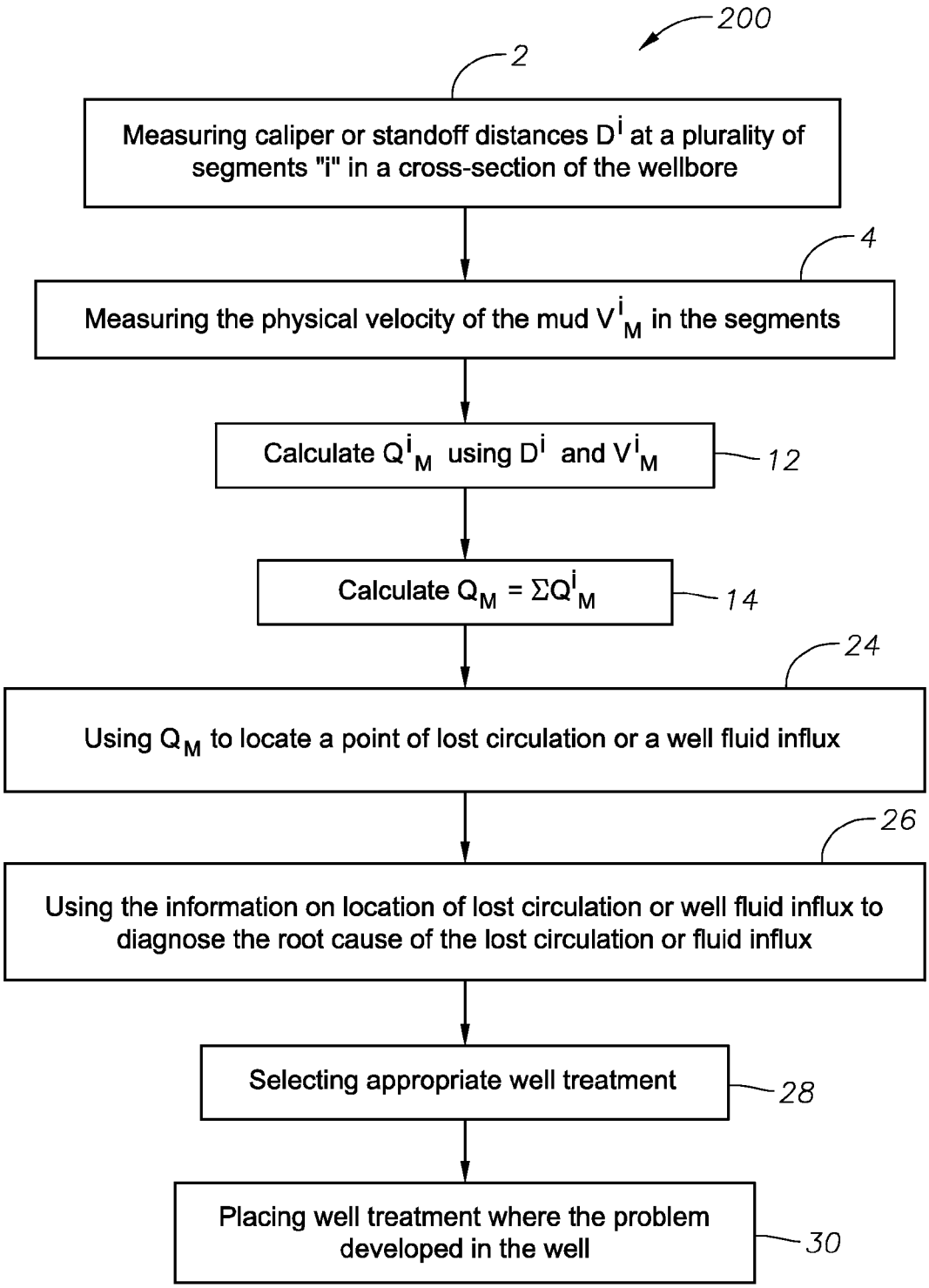
Figure 3:
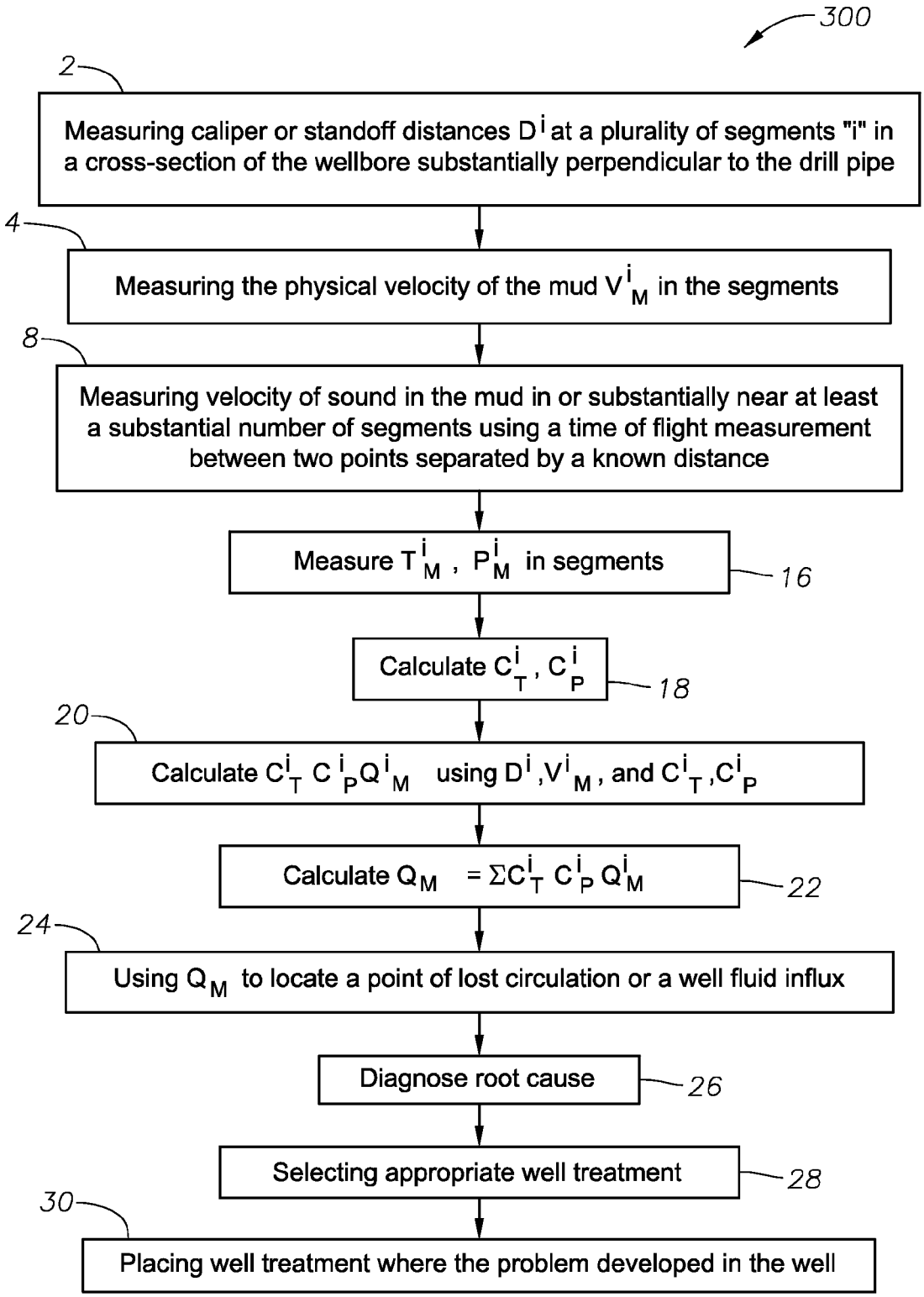
Figure 4:
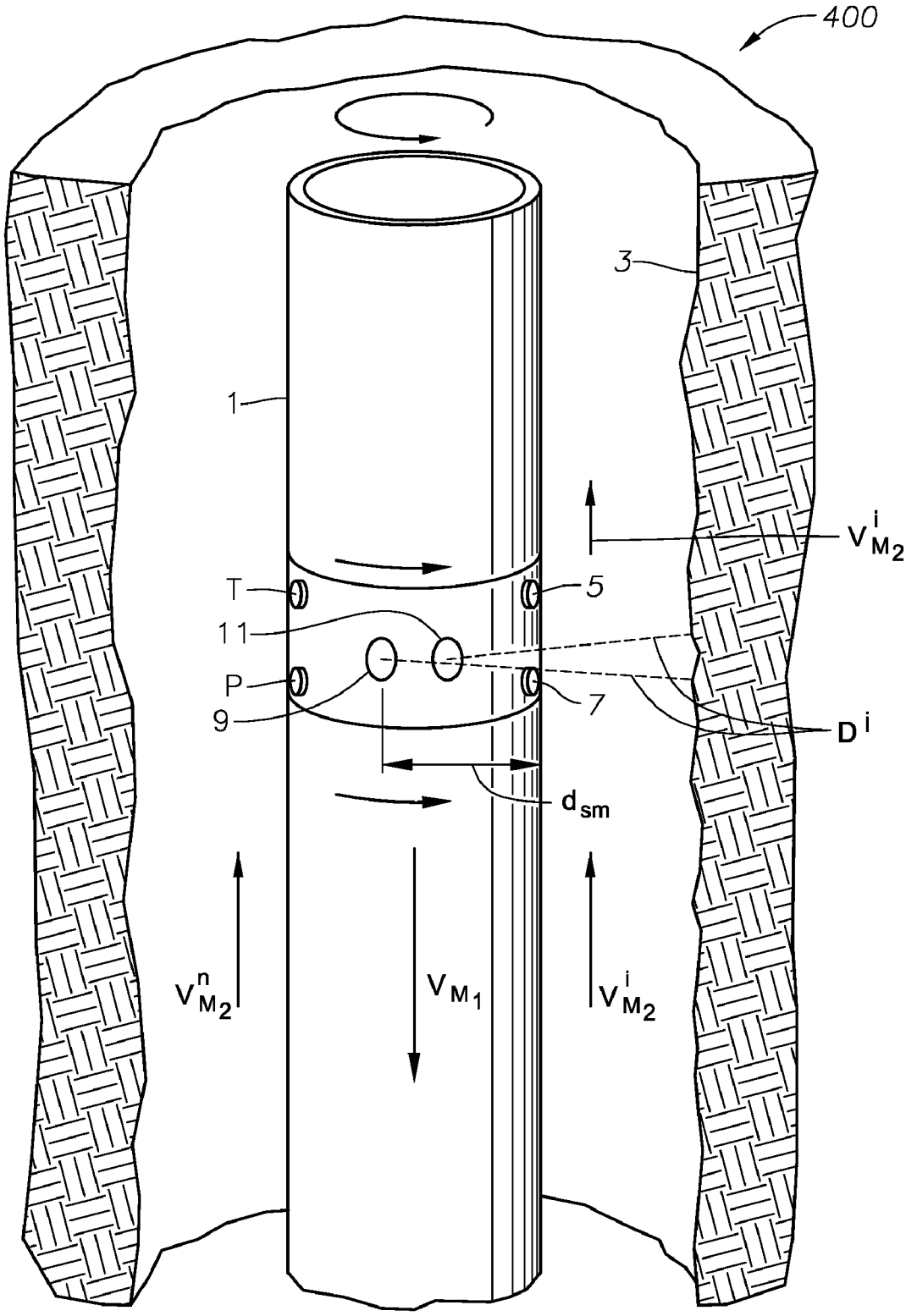
FIG. 4 illustrates schematically one method and apparatus in accordance with the present disclosure.
Figure 5:
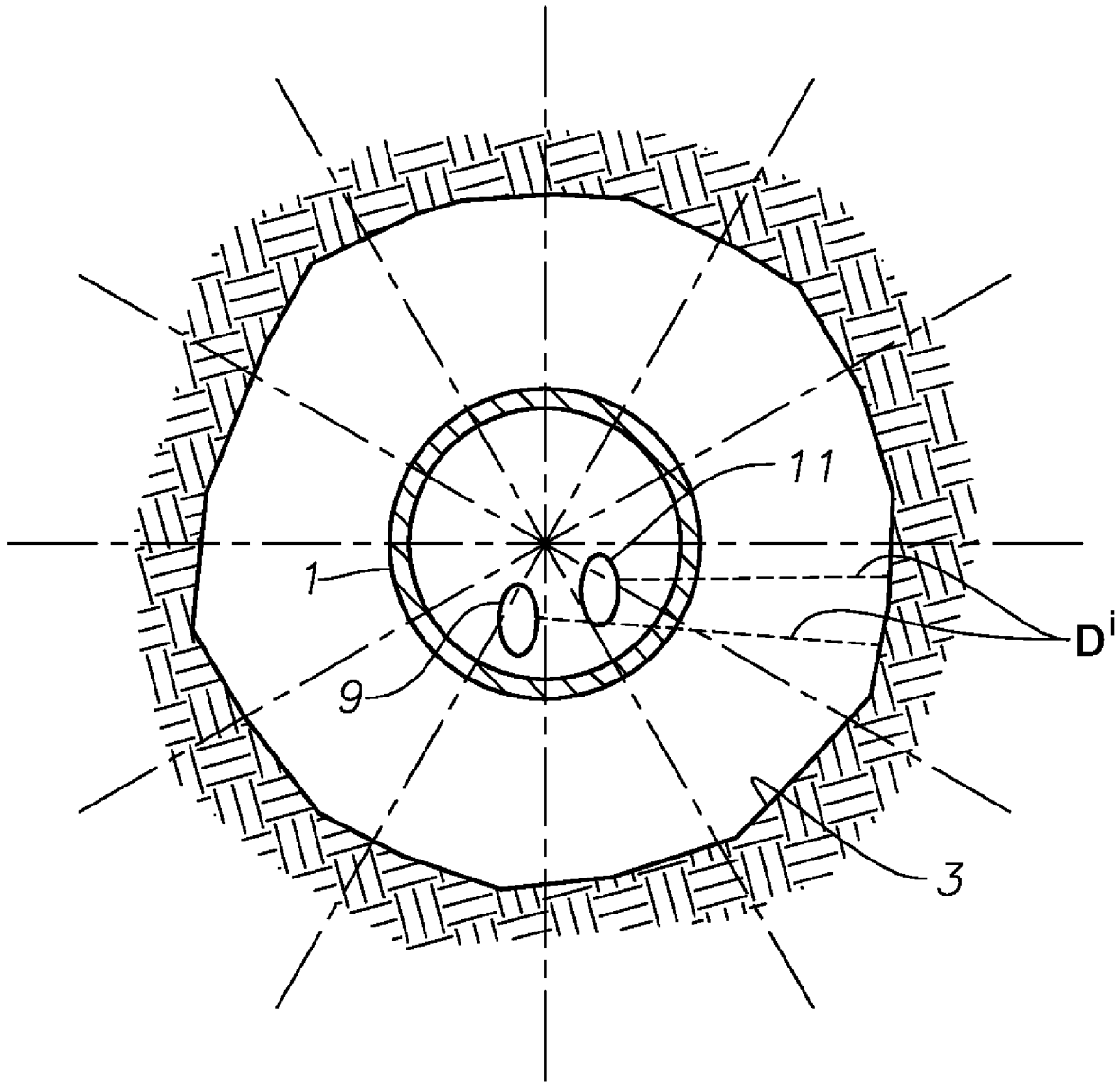
FIG. 5 is a cross-sectional view of the apparatus illustrated in FIG. 4.

FIGS. 1-3 illustrate three method embodiments of the present disclosure in flowchart form, using the terminology presented in FIGS. 4 and 5. Referring to FIGS. 4 and 5, these simplified schematic diagrams illustrate mud flowing through a drill pipe 1 generally downward at an axial velocity $V_{M_1}$, where the "1" designates flow inside the drill pipe. Drill pipe 1, or a portion thereof (such as a drill collar) rotates, as indicated by the circular arrow. A drill bit is not illustrated, but would be attached to a lower portion of drill pipe 1. The mud flows downward and exits through the drill bit, carrying rock cuttings generally upward in an annulus defined between an outer surface of drill pipe 1 and bore hole 3. Note that drill pipe 1 is depicted as generally constant diameter, while bore hole 3 has an irregular shape, as depicted in FIGS. 4 and 5. Due primarily to this varying borehole shape (diameter), the generally upward-flowing mixture of mud and rock flows in the annulus at varying axial velocities in various segments "i" around drill pipe 1. The mixture velocity (hereinafter referred to as simply the mud velocity) is denoted $V^i_{M_2}$, where the "i" designates the segment number and the "2" designates flow in the annulus. There may be "n" segments, and thus up to $V^n_{M_2}$ velocities. The number of segments depends on various factors, such as the ability of sensors to measure physical mud velocity and caliper in different segments with sufficient resolution. Also depicted in embodiment 400 of FIGS. 4 and 5 are a transmitter 7 and receiver 5 pair separated at a known distance for measuring physical mud velocity $V^i_{M_2}$, as well as a pair of transponders 9 and 11, as will be explained more fully herein, for measuring caliper or standoff distances in the segments. A distance $d_{sm}$ is indicated as a distance from transponder 9 to drill pipe 1. This distance may be useful in certain sensor configurations. Finally, temperature and pressure sensors T and P are depicted, for correcting acoustic measurements, as further explained herein.

Prior to discussing specific method embodiments 100, 200, and 300 illustrated in FIGS. 1-3, it bears noting again that the methods of this disclosure are meant to include using the determined actual volumetric flow rate not only for detection of lost circulation and well fluid influxes, but other well dysfunctions such as cuttings beds, fault movement, hole cleaning effectiveness, well bore washouts, and other well dysfunctions which might produce an anomaly in well mud velocities and well volumetric flow or flow distribution around the drill pipe. Embodiments 100, 200, and 300 are to be viewed merely as exemplary, and not limiting in any way. Embodiment 100 of FIG. 1 illustrates in box 2 measuring caliper or standoff distance $D^i$ in a plurality of segments "i" in a cross-section of a wellbore. In certain embodiments these segments will be substantially perpendicular to the drill pipe, but for the purposes of the present disclosure some degree of non-perpendicularity may be allowed. Box 4 illustrates measuring physical velocity of the mud ($V^i_{M2}$) in the plurality of segments. It should be pointed out that the steps illustrated in FIGS. 1-3 are merely for illustrating the concepts of the disclosure; it is not intended that the steps must be taken sequentially or in parallel. Box 8 indicates measuring velocity of sound in the mud in or substantially near at least a substantial number of the segments using a time of flight measurement between two points separated by a known distance. In embodiment 100, the next step, illustrated by box 10 is to ask whether acoustic sensors were used either in measuring distances, velocities, or both. If the answer is no, then box 12 illustrates calculating volumetric flow rate of mud through each annular segment "i" ($Q^i_M$) using $D^i$ and $V^i_{M_2}$, then summing or integrating the segment flow rates to determine a total flow rate past the point in the well, $Q_M=\Sigma Q^i_M$, as indicated in box 14.

If there are acoustic sensors being used in determining the distances and/or velocities, then the method of embodiment 100 proceeds from box 10 to box 16 illustrating measurements of $T^i_M$, $P^i_M$, the temperature and fluid pressure of the mud in each annular segment. Correction factors are then calculated, $C^i_T$, $C^i_P$, as indicated in box 18, and these correction factors used to calculate $C^i_T C^i_P Q^i_M$ using $D^i$, $V^i_{M_2}$, and $C^i_T$, $C^i_P$, as indicated in box 20. The total volumetric flow rate is then calculated, $Q_M=\Sigma C^i_T C^i_P Q^i_M$, as indicated in box 22.

FIG. 2 illustrates another method embodiment 200, with the same numerals used for method steps that are the same, such as steps indicated in boxes 2, 4, 12, and 14. Method embodiment 200 exemplifies using the annular volumetric flow rate $Q_M$ to locate a point of lost circulation, a well fluid influx, or other well dysfunction, box 24. The method of this embodiment then proceeds to use the information on location of lost circulation, well fluid influx, or other well dysfunction to diagnose the root cause of the lost circulation, fluid influx, or other well dysfunction, box 26, select an appropriate well treatment, box 28, and place the selected well treatment in the well, box 30.

FIG. 3 illustrates another method embodiment 300, with the same numerals used for method steps that are the same, such as steps indicated in boxes 2, 4, 8, 16, 18, 20 and 22 from embodiment 100 of FIG. 1, and boxes 24, 26, 28 and 30 from embodiment 200 from FIG. 2. Method embodiment 300 exemplifies using the annular volumetric flow rate $Q_M$ calculated from one or more acoustic sensors to locate a point of lost circulation, a well fluid influx, or other well dysfunction, box 24. The method of this embodiment then proceeds to use the information on location of lost circulation, well fluid influx, or other well dysfunction to diagnose the root cause of the lost circulation, fluid influx, or other well dysfunction, box 26, select an appropriate well treatment, box 28, and place the selected well treatment in the well, box 30.

Well treatments and techniques of placing those treatments in the well are varied, and depend on the specific problem encountered. Examples of problems and well treatments to treat the problems may be seen in the patent literature. For example, U.S. Pat. No. 7,128,148 provides a method and treatment fluid for blocking the permeability of an elevated-temperature zone in a reservoir of a subterranean formation penetrated by a wellbore, the method comprising the steps of: a) selecting the zone to be treated, wherein the upper limit of the temperature range of the zone is equal to or greater than 190° F. (88° C.); b) forming a well treatment fluid comprising: water; a water-soluble polymer comprising polymerized vinyl amine units; and an organic compound capable of crosslinking with the vinyl amine units of the water-soluble polymer; c) selecting the water-soluble polymer and the organic compound of the well treatment fluid such that the gel time of the well treatment fluid is at least 2 hours when measured at the upper limit of the temperature range of the zone; and d) injecting the well treatment fluid through the wellbore and into the zone. As another example, U.S. Pat. No. 7,007,752 describes a well treatment fluid for use in a well, the well treatment fluid comprising water; an amine-based polymer; an polysaccharide-based polymer; and an oxidizing agent that is capable of at least partially oxidizing at least the polysaccharide-based polymer. This patent also describes a method of treating a subterranean formation penetrated by a wellbore, the method comprising the steps of forming a well treatment fluid just described, and contacting the well treatment fluid with the subterranean formation. These patents, and the U.S. patents discussed therein are incorporated herein by reference. They are representative examples only; many other well treatments are known by those having ordinary skill in the well treatment art.

Any one of a number of methods and apparatus (sometimes referred to herein as "tools") may be used to measure caliper or standoff distances. The following discussion presents some non-limiting examples. In one technique (Zemanek, referred to above), a Circumferential Borehole Imaging Log ("CBIL") utilizes one or more focused, concave transducers having an operating frequency less than about 1.35 MHz. This device is depicted schematically in FIGS. 4 and 5. CBIL offers selectable focusing concave transducers 9, 11, which may be mounted on a rotating spindle (not shown), encapsulated in a transparent acoustic window. The transducers provide reflected amplitude and elapsed travel time data from 360 deg of borehole wall 3. The diameters of the transducers may be 1.5 and 2.0 inches (3.8 and 5 cm), for example, and may have a radius of curvature of about 6 inches (15 cm). The acoustic pulse-echo imaging tool usually comprises a rotating head on which is mounted the acoustic transducers 9, 11, such as piezoelectric or bender-type transducers. The transducers periodically emit an acoustic energy pulse on command from a controller circuit (not shown) in the tool. After emission of the acoustic energy pulse, the transducers 9, 11 can be connected to a receiving circuit (not shown), generally located in the tool, for measuring a returning echo of the previously emitted acoustic pulse which is reflected off wellbore wall 3. Circuitry, which can be in the tool or at the earth's surface, measures the echo or reflection travel time and the reflection amplitude. The measurements of reflection time and reflection amplitude are used by circuitry to generate graphs or images which correspond to the visual appearance, structure or other properties of the wellbore wall, such as in the present disclosure, caliper or standoff distances. Also included is a separate borehole fluid velocity transducer 5, 7 mounted in a cavity open to borehole fluid. This sensor provides accurate fluid velocities in oil-based mud up to 15 $lb_m$/gal [1.8 kg/L]. These data are used to obtain accurate borehole caliper information from the 360 deg elapsed travel time data. The CBIL transducers may operate at six revolutions per second. This provides three scans per vertical inch [1.2 scans per vertical cm] of borehole at a logging speed of ten feet per minute [3 meters per minute]. At a logging speed of five feet per minute [1.5 meters per minute], the CBIL can provide six scans per vertical inch [2.4 scans per vertical cm] of well.

The CBIL instrument such as illustrated in FIG. 4 may interface to a stand-alone auxiliary PC-based processing system at the surface which controls tool operation, data acquisition, storage, and display. Data may be stored on hard disk or on g-track magnetic tape. An interactive, PC-based software package has been developed to display and aid in interpretation of the CBIL data. A variable color display, along with image enhancement software, may be included to facilitate the classification of bedding planes and fractures, as well as optical orientation of vugs and washouts. Additional software capabilities may include: generation of synthetic cores, automated correlation of either synthetic curves (obtained from vertical strips of the CBIL reflectance image), or curves from other well logging instrumentation. In addition, the package may have the capability to perform multiwell data analysis by merging measurements from numerous geophysical evaluation devices utilized in seismic, core analysis, and wireline logging.

As noted by Zemanek et al., the fluid velocity in oil-based muds (OBM) increases with increasing pressure, at constant temperature. However, acoustic attenuation at 250 kHz in an 11 $lb_m$/gal [1.3 kg/L] OBM is a complicated function of pressure and temperature. Acoustic attenuation decreases with pressure at a constant temperature. Zemanek et al. note that attenuation as a function of temperature at a constant pressure is abnormal for a liquid. In fact, the behavior is such as found in viscoelastic liquids which exhibit thermal relaxation, and denser OBM fluids exhibit an even more complicated behavior than less dense OBM, even though both fluids have the same viscosity.

Another method and apparatus to measure caliper or standoff distances, as well as flow velocities in the annular segments, are the methods and apparatus described by Han, et al., in U.S. Pat. Nos. 6,938,458; 6,672,163; 6,817,229; 6,829,947; and 6,378,357, all previously incorporated herein by reference. For example, the '458 patent discloses an apparatus and system for in situ measurement of downhole fluid flow using Doppler techniques. As explained therein, a baseline speed of sound is first established close to the desired measurement point or points. Because the speed of sound can vary depending on pressure, temperature, and fluid composition, measuring the speed of sound close to the desired point may advantageously provide greatly enhanced accuracy. This speed of sound measurement is then used in Doppler calculations for determining flow velocities based on the Doppler shift induced by the fluid flow. A heterodyne receiver arrangement may be used for processing so that the flow direction can be determined and the detection sensitivity for "slow flow" velocities can be enhanced. This allows for more accurate estimation of flow velocities, which may be in the axial, radial, and/or tangential directions in the annulus. Although these flow velocities may be used to determine well kicks, and porous formations may be identified by flow of the mud into the formation, and formation fractures (and orientations) may similarly be identified by fluid flow patterns, the present disclosure goes beyond detection of flow velocities, and computes actual volumetric flow rates.

Figure 6:
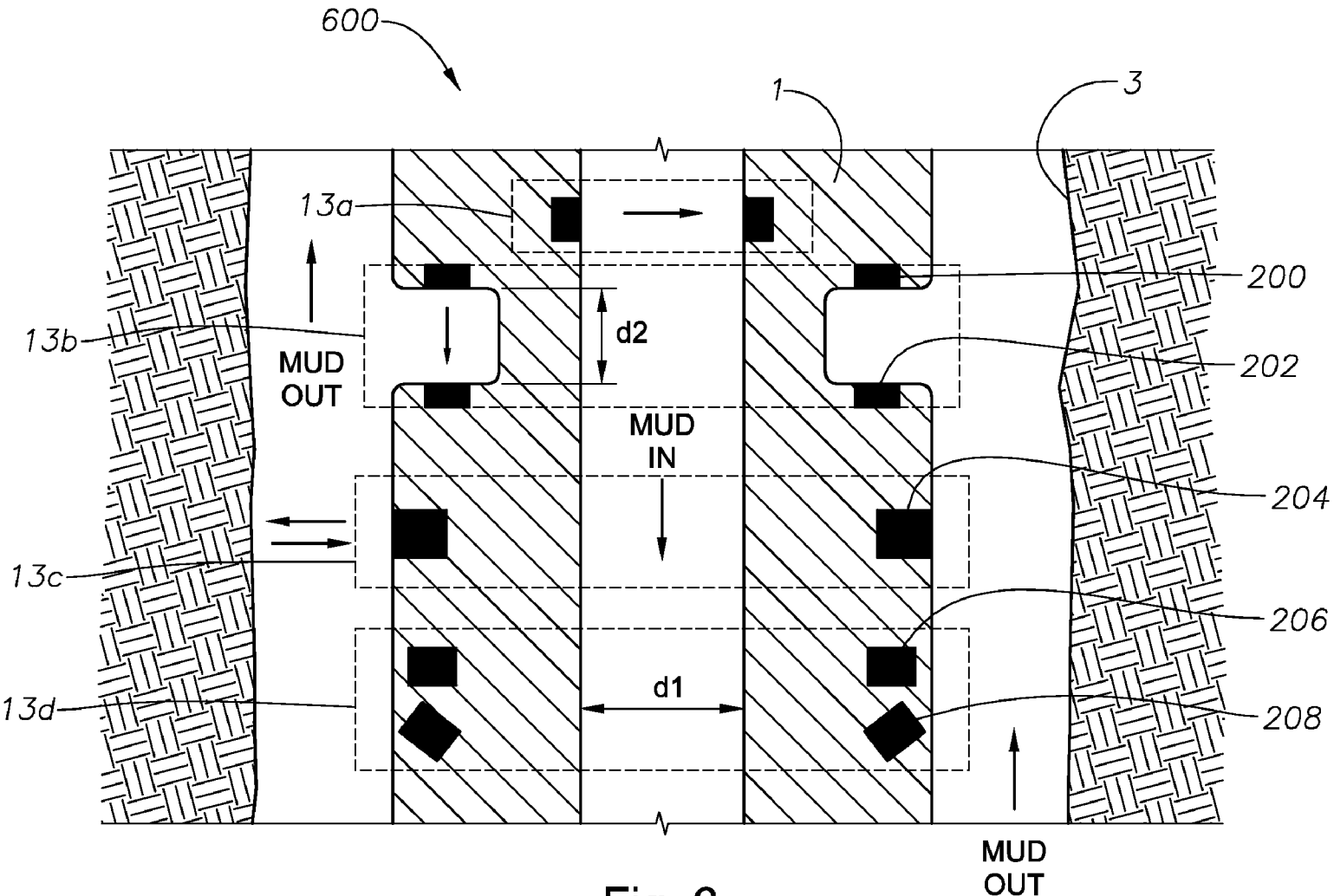
Fig. 6 (Prior Art)
FIGS. 6 and 7 illustrate schematically two prior art apparatus for measuring caliper or standoff distances, as well as mud flow velocities, using acoustic sensors.

FIG. 6, adapted from FIG. 2 of the '458 patent, shows a cross sectional view of an embodiment 600 for the drill pipe 1 including sensors 13*a*, 13*b*, 13*c*, and 13*d* which further include transducers. It should be noted that an acoustic transducer, as that term is used herein, may both produce and receive acoustic signals. Incoming mud is shown on the interior of the drill pipe 1, and outgoing mud is shown in the annulus where it is measured by sensor arrangements 13*a*, 13*b*, 13*c*, and 13*d*. Note that although the mud is shown advancing in the annulus, it may actually be receding in the annulus, for example due to a loss of fluid to the formation. Sensor 13*a* is used to measure a baseline speed of sound of the mud inside drill pipe 1, which is shown having an inner diameter of d1. Sensor 13*b* is used in measuring a baseline speed of sound measurement of the mud in the annulus. Sensor 13*b* may include at least one acoustic transducer 200 located in a first circular plane and at least one acoustic transducer 202 located in a second circular plane, where the two circular planes are concentric with respect to drill pipe 1. The two circular planes are separated by a known distance d2. Transducer 200 may produce acoustic waves in the mud and transducer 202 receives these acoustic waves. Processing logic (not shown) determines the speed of sound based on the distance d2 (d1 for sensor 13*a*) and the time it takes to travel between the two transducers. The configuration of transmitting and receiving transducers may be reversed allowing the results under each scenario to be averaged thereby yielding a more accurate speed of sound measurement. Subsequently, this speed of sound measurement, may, if the drill pipe is rotating, obtain a plurality of speed of sound readings around the drill pipe, and may be used in calculating the velocity of fluid flow in the axial direction in the annulus in a plurality of segments, in accordance with the present disclosure.

As an alternative to the embodiment of FIG. 6, sensors 13*a* and 13*b* may be of the type disclosed in U.S. Pat. No. 6,513,385, which is hereby incorporated by reference. Such sensors may comprise a piezoelectric or ferroelectric transducer having front and back faces; a backing member acoustically coupled to the transducer back face and impedance-matched to the transducer element, the backing member having proximal and remote faces; and a delay material disposed between the transducer front face and the wall outer surface.

Referring still to FIG. 6, sensor 13*c* may be a pulse-echo arrangement including at least one transmit/receive transducer 204. Transducer 204 produces acoustic signals which travel radially through the annulus to the borehole wall and are reflected back to transducer 204. Processing logic (not shown) determines the annular gap (caliper) using the speed of sound measurement from sensor 13*b*. Sensor 13*d* includes a transmitting transducer 206 and a receiving transducer 208. Transducer 206 may be oriented in an axial plane on the circumference of drill pipe 1 and emits acoustic signals radially into the annulus. Transducer 208 is oriented in the same axial plane on the circumference of drill pipe 1 and is further angled so as to receive acoustic signals that are Doppler shifted in frequency by the mud in the annulus. Processing logic (not shown) determines the axial velocity and direction of the mud in the annulus using the Doppler shifted signal from transducer 206 and the speed of sound measurement from sensor 13*b*. Thus, the transmit/receive pair 206 and 208 are able to measure the flow of mud in the axial direction in the annulus as well as determine its direction of travel (i.e., in or out of the annulus).

Transducers 200 through 208 may be piezoelectric or magnetic transducers that have a broad frequency response and support a wide frequency range, thus supporting signal propagation through different depths of investigation in the annulus. Note that sensor 13*b* should be located in close proximity to sensors 13*c* and 13*d* because the in situ speed of sound in the mud at different locations varies due to temperature, pressure, and fluid composition. Therefore, other methods which fail to take into account local speed of sound variations (e.g., look up tables based on laboratory data) will not yield as accurate of information as using an in situ speed of sound measurement.

Figure 7:
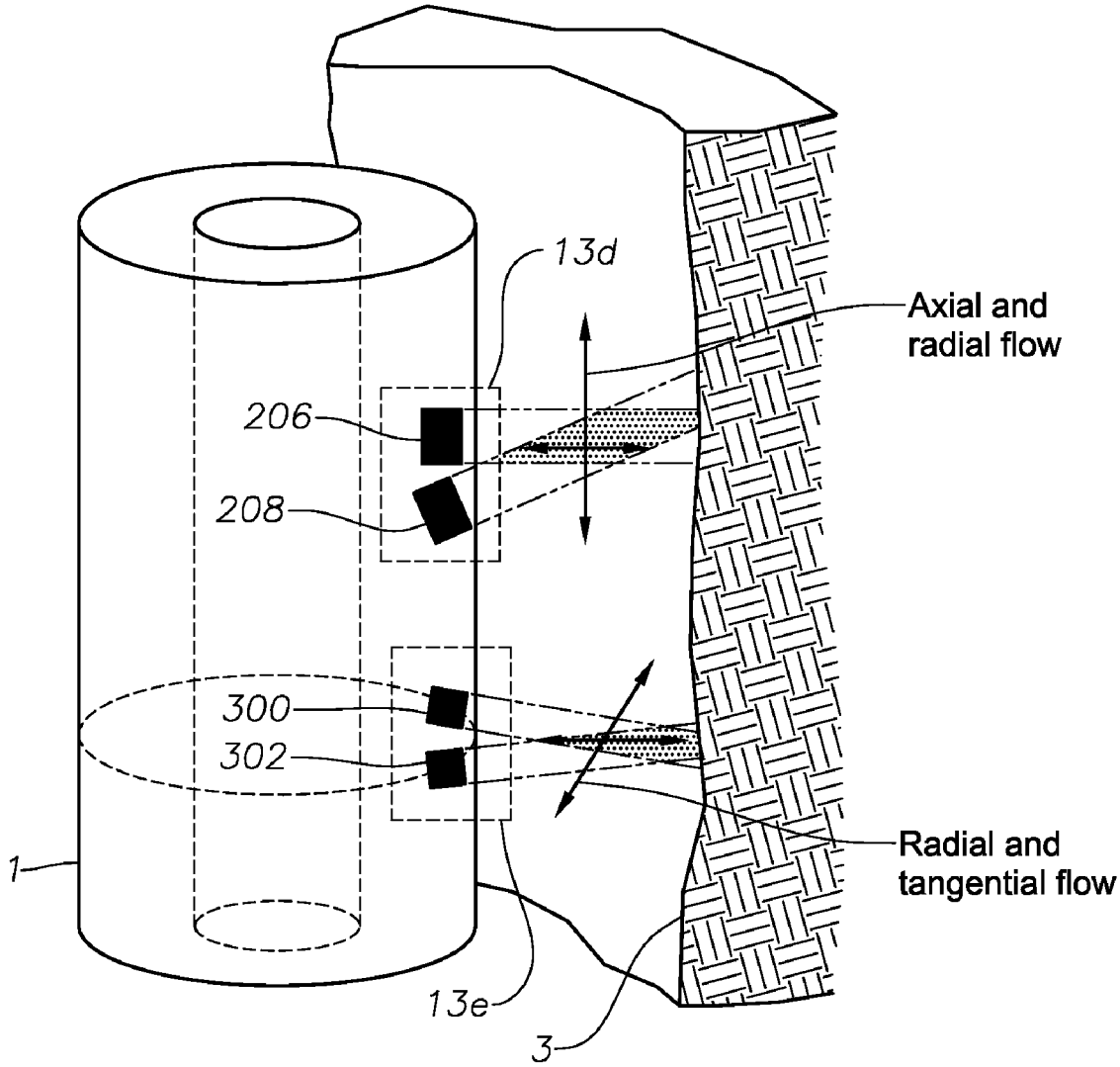
Fig. 7 (Prior Art)

Turning to FIG. 7, which is adapted from FIG. 3 of the '458 patent, another embodiment of the sensor configuration is shown. Sensor 13*d*, as discussed previously, is shown measuring axial flow and direction in the annulus. Sensor 13*e* includes a transmitting transducer 300 and a receiving transducer 302. Transducer 300 may be oriented on a circular plane on the circumference of the drill pipe 1 and is further angled such that it emits acoustic signals in a non-perpendicular direction into the annulus. Transducer 302 is oriented on the same circular plane on the circumference of drill pipe 1 and is angled so as to receive the acoustic signals transmitted by transducer 300, which have been Doppler shifted in frequency by the mud in the annulus. Processing logic (not shown) determines the radial velocity and direction of the mud in the annulus using the Doppler shifted signal and the baseline speed of sound measurement from sensor 13*b*.

Figure 8:
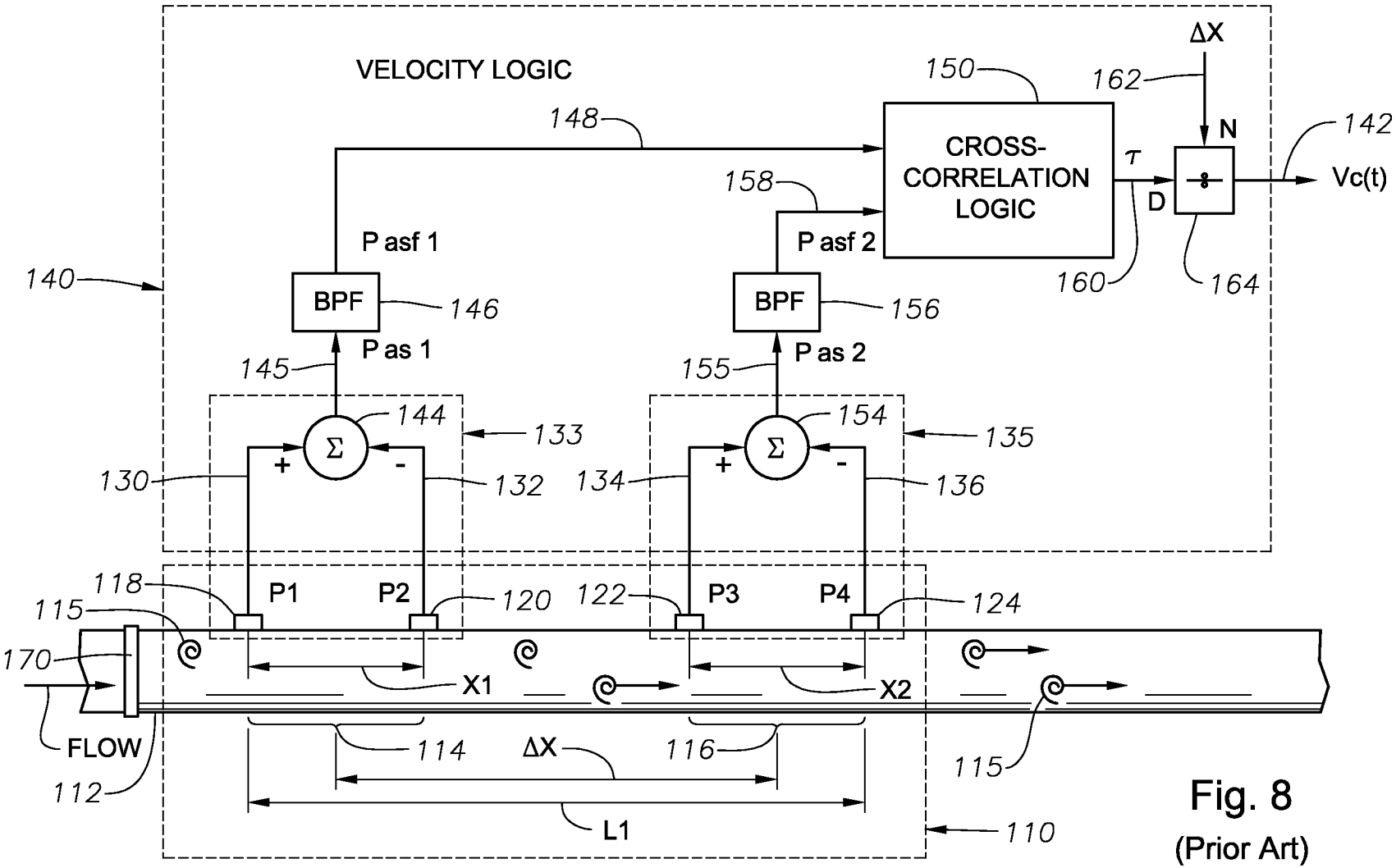
Fig. 8 (Prior Art)
FIG. 8 illustrates schematically an acoustic method and apparatus for measuring mud flow velocities using a sonar method.

Another acoustic technique to measure mud flow velocities is the sonar method described by Gysling et al., in their array of patents, especially U.S. Pat. No. 6,691,584, incorporated herein by reference. In the '584 patent, the velocity and flow measurement system utilizes pressure sensors to provide a signal indicative of the velocity of a fluid or of at least one of the fluids in a fluid mixture flowing in the pipe, as illustrated in FIG. 8, which is adapted from FIG. 1 of the '584 patent. It will be understood that these methods and apparatus may be adapted to the annulus situation. The velocity and flow system will work over a wide range of mixtures of, for example, oil, water, and/or gas within the annulus. The various constituents have pressure disturbances convecting therewith having particular axial and coherence lengths. As explained in the '584 patent, the method utilizes an array of spatial filters to detect and identify the various pressure disturbances, such as vortical pressure disturbances, in the fluid or in a particular constituent within the mixture. Once detected, the pressure disturbances are filtered to obtain a convection velocity. Referring to FIG. 8, a system for detecting and measuring vortical pressure disturbances in a fluid moving in a pipe to determine the velocity and flow of the fluid includes a sensing section 110 along a pipe 112 and a velocity logic section 140. The pipe (or conduit) 112 has two measurement regions 114, 116 located a distance AX apart along the pipe 112. At the first measurement region 114 are two pressure sensors 118, 120, located a distance $X_1$ apart, capable of measuring the unsteady pressure in the pipe 112, and at the second measurement region 116, are two other unsteady pressure sensors 122, 124, located a distance $X_2$ apart, capable of measuring the unsteady pressure in the pipe 112. Each pair of pressure sensors 118, 120 and 122, 124 act as spatial filters to remove certain acoustic signals from the unsteady pressure signals, and the distances $X_1$, $X_2$ are determined by the desired filtering characteristic for each spatial filter, as discussed below.

The flow measurement system illustrated in FIG. 8 measures velocities associated with unsteady flow fields and/or pressure disturbances represented by 115. Such pressure disturbances could represent turbulent eddies (or vortical flow fields), inhomogeneities in the flow (such as bubbles, slugs, solids and the like), or any other properties of the flow having time varying or stochastic properties that are manifested at least in part in the form of unsteady pressures. Flow fields 115 are, in general, comprised of pressure disturbances having a wide variation in length scales and which have a variety of coherence length scales, such as those described in the reference "Sound and Sources of Sound," A. P. Dowling et al., Halsted Press, 1983, which is incorporated herein by reference. Certain of these flow fields convect at, or near to, or are related to, the mean velocity of a fluid or of at least one of the fluids within a mixture flowing in a pipe. More specifically, vortices convect in a predictable manner with reference to such fluids or mixtures. The flow fields 115 have temporal and spatial length scales as well as coherence length scales that differ from other disturbances in the flow. The methods of the present disclosure utilize these properties to preferentially select disturbances of a desired spatial (axial or transverse) length scale and coherence length scale, as more fully explained in the '584 patent. For illustrative purposes, the terms vortical flow field and vortical pressure field are used to describe the above-described group of unsteady pressure fields having temporal and spatial length and coherence scales described herein.

The pressures $P_1$, $P_2$, $P_3$, $P_4$ present at each of the sensors 118-124 may be measured through holes in the pipe 112 (which would be the drill pipe in accordance with the present disclosure) ported to sensors or by other techniques. The pressure sensors 118, 120, 122, 124 provide time-based pressure signals $P_1(t)$, $P_2(t)$, $P_3(t)$, $P_4(t)$ on lines 130, 132, 134, 136, respectively, to velocity logic 140, which provides a convection velocity signal $V_c(t)$ on a line 142. $V_c(t)$ is related to an average flow rate $V_f(t)$ of the fluid flowing in the pipe 112, or in the annulus in accordance with the present disclosure.

As one skilled in the art will recognize, some or all of the functions performed by velocity logic 140 may be implemented in software (using a microprocessor or computer) and/or firmware, or may be implemented using analog and/or digital hardware having sufficient memory, interfaces, and capacity to perform the functions described herein.

In one embodiment, the pressure signal $P_1(t)$ on line 130 is provided to a positive input of a summer 144 and the pressure signal $P_2(t)$ on line 132 is provided to a negative input of the summer 144. The output of the summer 144 is provided on a line 145 indicative of the difference between the two pressure signals $P_1$, $P_2$ (e.g., $P_1$-$P_2$=$P_{as1}$). The inputs to summer 144 may be swapped with the pressure signal $P_1(t)$ on line 130 provided to the negative input and the pressure signal $P_2(t)$ on line 132 provided to the positive input without departing from the present disclosure.

The pressure sensors 118,120 together with the summer 144 create a spatial filter 133. Line 145 is fed to bandpass filter 146, which passes a predetermined passband of frequencies and attenuates frequencies outside the passband. In accordance with the present disclosure, the passband of the filter 146 is set to filter out (or attenuate) the dc portion and the high frequency portion of the input signals and to pass the frequencies therebetween. For example, in a particular embodiment, passband filter 146 is set to pass frequencies from about 1 Hz to about 100 Hz, which is a useful range for detecting pressure disturbances in a 3-inch [7.6 cm] inside-diameter pipe flowing water at 10 ft/sec [305 cm/sec]. Other passbands may be used in other embodiments, if desired. Passband filter 146 provides a filtered signal $P_{asf}1$ on a line 148 to cross-correlation logic 150.

The pressure signal $P_3(t)$ on line 134 is provided to a positive input of a summer 154 and the pressure signal $P_4(t)$ on line 136 is provided to a negative input of the summer 154. The pressure sensors 122,124 together with the summer 154 create a spatial filter 135. The output of the summer 154 is provided on a line 155 indicative of the difference between the two pressure signals $P_3$, $P_4$ (e.g., $P_3-P_4=P_{as2}$). The line 155 is fed to a bandpass filter 156, similar to the bandpass filter 146 discussed above, which passes frequencies within the passband and attenuates frequencies outside the passband. The filter 156 provides a filtered signal $P_{asf2}$ on line 158 to cross-correlation logic 150. The signs on the summers 144,154 may be swapped if desired, provided the signs of both summers 144,154 are swapped together. In addition, the pressure signals $P_1$, $P_2$, $P_3$, $P_4$ may be scaled prior to presentation to the summers 144,154.

Signals $P_{asf1}$ and $P_{asf2}$ on lines 148,158, respectively, are indicative of the presence of a pressure disturbance (such as vortices) in a flow field 115, which occur in sensing regions 114, 116, respectively. The cross-correlation logic 150 calculates a well-known time domain cross-correlation between the signals $P_{asf1}$ and $P_{asf2}$ on the lines 148,158, respectively, and provides an output signal on a line 160 indicative of the time delay $\tau$ it takes for an vortical flow field 115 to propagate from one sensing region 114 to the other sensing region 116. Vortical flow disturbances, as is known, are coherent dynamic conditions that can occur in the flow, and which substantially decay (by a predetermined amount) over a predetermined distance (or coherence length) and convect (or flow) at or near the average velocity of the fluid flow. As described above, a flow field 115 also has a stochastic or vortical pressure disturbance associated with it. In general, the vortical flow disturbances 115 are distributed throughout the flow, particularly in high shear regions, such as boundary layers (e.g., along the inner wall of pipe 112) and are shown herein as discrete vortical flow fields 115. Because the vortical flow fields 115 (and the associated pressure disturbance) convect at or near the mean flow velocity, the propagation time delay $\tau$ is related to the velocity of the flow, the distance $\Delta X$ between the measurement regions 114,116 being known.

Although pressure disturbances associated with flow fields 115 occur naturally in most flow conditions, an optional circumferential groove 170 may be used in the inner diameter of pipe 112 to help generate vortices into the flow. However, groove 170 is not required for these methods to operate, which can operate using pressure disturbances occurring naturally in the flow of the fluid(s) within pipe 112. However, should it be desired in a given application, a plurality of axially spaced grooves may be used to generate further vortices. The dimensions and geometry of the groove(s) 170 may be set based on the expected flow conditions and other factors. The axial cross-sectional shape of groove 170 may be rectangular, square, triangular, circular, oval, star, or other shapes. Other techniques may be used as vortex generators if desired including those that may protrude within the inner diameter of pipe 112.

A spacing signal $\Delta X$ on line 162, indicative of the distance $\Delta X$ between the sensing regions 114,116, is divided by the time delay signal $\tau$ on the line 160 by a divider 164 which provides an output signal on the line 142 indicative of the convection velocity $V_c(t)$ of the fluid flowing in pipe 112, which is related to (or proportional to or approximately equal to) the average (or mean) flow velocity $V_f(t)$ of the fluid, as defined below:

$$V_c(t)=\Delta X/\tau\approx V_f(t)$$

The convection velocity $V_c(t)$ may then be calibrated to more precisely determine the mean velocity $V_f(t)$ if desired. The result of such calibration may require multiplying the value of the convection velocity $V_c(t)$ by a calibration constant (gain) and/or adding a calibration offset to obtain the mean flow velocity $V_f(t)$ with the desired accuracy. Other calibration may be used if desired. For some applications, such calibration may not be required to meet the desired accuracy. The velocities $V_f(t)$, $V_c(t)$ may be converted to volumetric flow rate by multiplying the velocity by the cross-sectional area of the pipe.

Other configurations similar to that shown in FIG. 8 are possible. Thus, several filters can be used in combination with velocity logic 140 to determine flow rate properties of a fluid or a mixture of fluids. In a multi-filter embodiment, various spacing signals $\Delta X$ on a line 162 indicative of the distances $\Delta X_1$, $\Delta X_2$, $\Delta X_3$, $\Delta X_4$ between the sensing regions are divided by the various time delay signals $\tau$ associated with each time lag between the filters. Each divider 164 provides various output signals on the line 142 indicative of convection velocities $V_c(t)_1$, $V_c(t)_2$, $V_c(t)_3$, which, for example, each relate to a particular constituent of a three constituent mixture of fluids flowing in pipe 112. The various convection velocities are related to (or proportional to or approximately equal to) the average (or mean) flow velocity $V_f(t)_1$, $V_f(t)_2$, $V_f(t)_3$ of the various constituents of the fluid mixture. The velocities $V_c(t)_1$, $V_c(t)_2$, $V_c(t)_3$ and $V_f(t)_1$, $V_f(t)_2$, $V_f(t)_3$ may be converted to volumetric flow rate if there is sufficient knowledge of the phase concentrations and cross sectional area of the pipe. Such configurations may also be used to determine a mean velocity for the fluid mixture.

In accordance with the present disclosure, a primary interest lies in using one or more of the methods and apparatus described above to obtain a plurality of caliper or standoff distances in a plurality of segments, as well as a plurality of mud velocities in the segments, to calculate the total volumetric flow rate of mud in the annulus, and using this information to diagnose, make decisions on, and implement well treatment options to fix undesirable well behaviors such as lost circulation, fluid influxes, kicks, the build-up of cuttings beds, and the like, in the well. The skilled operator or designer will determine which methods and apparatus for measuring distances and velocities, and which well treatment options are best suited for a particular well and formation to achieve the highest efficiency without undue experimentation. There are multiple potential root causes of, for instance, lost circulation which may be encountered in a well and include an induced fracture, a natural fracture, vuggy formations, faults, poor isolation at a casing shoe, seepage losses, a hole in casing, etc. Each of these root causes may be best treated by some particular treatment, but no one treatment is most effective for all root causes. Therefore, understanding the root cause will lead to the selection of the most effective treatment. Placement of the treatment into the well can impact the effectiveness of the treatment. The distance the treatment must move through the well to reach the point to be treated can result in contamination of the treatment and, therefore, less effective results of the application of the treatment.

Apparatus useful in the invention may include means for measuring temperature and annular fluid pressure in each segment. Suitable temperature measurement means include thermocouples, thermistors, resistant temperature detectors (RTDs), and the like. Suitable fluid pressure measurement means include piezoelectric sensors, fiber optic sensors, strain gauges, microelectromechanical (MEMS) sensors, and the like. The apparatus and methods of the present disclosure may also include means for calculating temperature- and pressure-corrected caliper or standoff distances using the measured temperature and annular fluid pressure in each segment. Suitable means for calculating include digital computers, and the like, either hard-wired or wirelessly connected to the tools, and which may include wired or wireless connections to human-readable devices, such as video CRT screens, printers, and the like.

Useful drilling muds for use in the methods of the present disclosure include water-based, oil-based, and synthetic-based muds. The choice of formulation used is dictated in part by the nature of the formation in which drilling is to take place. For example, in various types of shale formations, the use of conventional water-based muds can result in a deterioration and collapse of the formation. The use of an oil-based formulation may circumvent this problem. A list of useful muds would include, but not be limited to, conventional muds, gas-cut muds (such as air-cut muds), balanced-activity oil muds, buffered muds, calcium muds, deflocculated muds, diesel-oil muds, emulsion muds (including oil emulsion muds), gyp muds, oil-invert emulsion oil muds, inhibitive muds, kill-weight muds, lime muds, low-colloid oil muds, low solids muds, magnetic muds, milk emulsion muds, native solids muds, PHPA (partially-hydrolyzed polyacrylamide) muds, potassium muds, red muds, saltwater (including seawater) muds, silicate muds, spud muds, thermally-activated muds, unweighted muds, weighted muds, water muds, and combinations of these.

Useful mud additives include, but are not limited to asphaltic mud additives, viscosity modifiers, emulsifying agents (for example, but not limited to, alkaline soaps of fatty acids), wetting agents (for example, but not limited to dodecylbenzene sulfonate), water (generally a NaCl or $CaCl_2$ brine), barite, barium sulfate, or other weighting agents, and normally amine treated clays (employed as a viscosification agent). More recently, neutralized sulfonated ionomers have been found to be particularly useful as viscosification agents in oil-based drilling muds. See, for example, U.S. Pat. Nos. 4,442,011 and 4,447,338, both incorporated herein by reference. These neutralized sulfonated ionomers are prepared by sulfonating an unsaturated polymer such as butyl rubber, EPDM terpolymer, partially hydrogenated polyisoprenes and polybutadienes. The sulfonated polymer is then neutralized with a base and thereafter steam stripped to remove the free carboxylic acid formed and to provide a neutralized sulfonated polymer crumb. To incorporate the polymer crumb in an oil-based drilling mud, the crumb must be milled, typically with a small amount of clay as a grinding aid, to get it in a form that is combinable with the oil and to keep it as a noncaking friable powder. Often, the milled crumb is blended with lime to reduce the possibility of gelling when used in the oil. Subsequently, the ionomer containing powder is dissolved in the oil used in the drilling mud composition. To aid the dissolving process, viscosification agents selected from sulfonated and neutralized sulfonated ionomers can be readily incorporated into oil-based drilling muds in the form of an oil soluble concentrate containing the polymer as described in U.S. Pat. No. 5,906,966, incorporated herein by reference. In one embodiment, an additive concentrate for oil-based drilling muds comprises a drilling oil, especially a low toxicity oil, and from about 5 gm to about 20 gm of sulfonated or neutralized sulfonated polymer per 100 gm of oil. Oil solutions obtained from the sulfonated and neutralized sulfonated polymers used as viscosification agents are readily incorporated into drilling mud formulations.

The mud system used may be an open or closed system. Any system used should allow for samples of circulating mud to be taken periodically, whether from a mud flow line, a mud return line, mud motor intake or discharge, mud house, mud pit, mud hopper, or two or more of these, as dictated by the resistivity data being received.

In actual operation, depending on the mud report from the mud engineer, the drilling rig operator (or owner of the well) has the opportunity to adjust the density, specific gravity, weight, viscosity, water content, oil content, composition, pH, flow rate, solids content, solids particle size distribution, resistivity, conductivity, and combinations of these properties of the mud. The mud report may be in paper format, or more likely today, electronic in format. The change in one or more of the list parameters and properties may be tracked, trended, and changed by a human operator (open-loop system) or by an automated system of sensors, controllers, analyzers, pumps, mixers, agitators (closed-loop systems).

"Drilling" as used herein may include, but is not limited to, rotational drilling, directional drilling, non-directional (straight or linear) drilling, deviated drilling, geosteering, horizontal drilling, and the like. Rotational drilling may involve rotation of the entire drill string, or local rotation downhole using a drilling mud motor, where by pumping mud through the mud motor, the bit turns while the drillstring does not rotate or turns at a reduced rate, allowing the bit to drill in the direction it points. A turbodrill may be one tool used in the latter scenario. A turbodrill is a downhole assembly of bit and motor in which the bit alone is rotated by means of fluid turbine which is activated by the drilling mud. The mud turbine is usually placed just above the bit.

"Bit" or "drill bit", as used herein, includes, but is not limited to antiwhirl bits, bicenter bits, diamond bits, drag bits, fixed-cutter bits, polycrystalline diamond compact bits, roller-cone bits, and the like. The choice of bit, like the choice of drilling mud, is dictated in part by the nature of the formation in which drilling is to take place.

The rate of penetration (ROP) during drilling methods of this disclosure depends on permeability of the rock (the capacity of a porous rock formation to allow fluid to flow within the interconnecting pore network), the porosity of the rock (the volume of pore spaces between mineral grains expressed as a percentage of the total rock volume, and thus a measure of the capacity of the rock to hold oil, gas, or water), and the amount or percentage of vugs. Generally the operator or owner of the well wishes the ROP to be as high as possible toward a known trap (any geological structure which precludes the migration of oil and gas through subsurface rocks, causing the hydrocarbons to accumulate into pools), without excess tripping in and out of the wellbore.

From the foregoing detailed description of specific embodiments, it should be apparent that patentable methods and apparatus have been described. Although specific embodiments of the disclosure have been described herein in some detail, this has been done solely for the purposes of describing various features and aspects of the methods and apparatus, and is not intended to be limiting with respect to the scope of the methods and apparatus. It is contemplated that various substitutions, alterations, and/or modifications, including but not limited to those implementation variations which may have been suggested herein, may be made to the described embodiments without departing from the scope of the appended claims. For example, drill bit, drilling muds, and mud flow velocity and caliper measurement apparatus other than those specifically described above may be employed, and are considered within the disclosure.

What is claimed is:

1. A method of determining volumetric flow rate in an annulus past one or more points in a well, the method comprising:

a) measuring caliper or standoff distance in a plurality of segments in a cross-section of a wellbore substantially perpendicular to a drill pipe during drilling;

b) measuring physical velocity of material in the plurality of segments during drilling;

c) computing volumetric flow rate of the material through each segment using the caliper or standoff distances and velocities; and d) summing or integrating the volumetric flow rates to determine a total volumetric flow rate of the material past one or more points in the well.

2. The method of claim 1 comprising measuring the caliper or standoff distances in the plurality of segments using a method selected from acoustic, mechanical, electromagnetic, and rotational density methods.

3. The method of claim 2 wherein the caliper or standoff distance is measured using an acoustic method, the acoustic method being selected from an acoustic pulse echo method, a Doppler shift method, and a sonar method.

4. The method of claim 3 further comprising measuring velocity of sound in the material in or substantially near at least a substantial number of the segments using a time of flight measurement between two points separated by a known distance, and using the velocity of sound measurement to more accurately calculate the distance from a pulse echo measurement.

5. The method of claim 1 wherein the measuring of physical velocity of the material comprises using a method selected from time of flight measurement between two points separated by a known distance, a Doppler method, a sonar method, a mechanical method, and a neutron activation method.

6. The method of claim 1 further comprising measuring temperature and annular fluid pressure in each segment, and calculating temperature- and pressure-corrected caliper or standoff distances using the measured temperature and annular fluid pressure in each segment.

7. The method of claim 6 wherein the temperature- and pressure-corrected caliper or standoff distances are applied to correct some or all of the physical velocity measurements.

8. The method of claim 1 further comprising using the total volumetric flow rate to locate a point or points of well dysfunction.

9. The method of claim 8 further comprising using the information on location of a point or points of well dysfunction to diagnose root cause of the well dysfunction, and once the root cause is diagnosed, selecting an appropriate well treatment, and placing the well treatment where the dysfunction has developed in the well.

10. The method of claim 1 further comprising measuring the distances and velocities continuously.

11. The method of claim 1 wherein the measurements of caliper and physical velocity of the material occur at a single point along the drill pipe.

12. The method of claim 1 wherein the measurements of caliper and physical velocity of the material occur at a plurality of points along the drill pipe.

13. A method of locating a point or points of dysfunction in an annulus of a well while the well is being drilled with a drill pipe, a drill bit attached to the drill pipe, and a flowing drilling mud, the method comprising:

a) measuring caliper or standoff distance in a plurality of segments in a cross-section of the wellbore substantially perpendicular to the drill pipe;

b) measuring physical velocity of material in the plurality of segments;

c) computing volumetric flow rate of the material through each segment using the caliper or standoff distances and velocities;

d) summing or integrating the volumetric flow rates to determine a total volumetric flow rate of material past the one or more points in the well; and e) using the total volumetric flow rate to locate a point or points of dysfunction in the well.

14. The method of claim 13 comprising measuring the caliper or standoff distances in the plurality of segments using a method selected from acoustic, mechanical, electromagnetic, and rotational density methods.

15. The method of claim 14 wherein the caliper or standoff distance is measured using an acoustic method, the acoustic method being selected from an acoustic pulse echo method, a Doppler shift method, and a sonar method.

16. The method of claim 13 further comprising using the information on the point or points of well dysfunction to diagnose root cause of the well dysfunction.

17. The method of claim 16 wherein once the root cause of the well dysfunction is diagnosed, selecting an appropriate well treatment, and placing the well treatment where the well dysfunction has developed in the well.

18. An apparatus for determining volumetric flow rate at a point or points downhole in a wellbore annulus, comprising:

a) one or more sensors for measuring a plurality of distances between a drill pipe and borehole wall in a plurality of annular segments;

b) a sensor for measuring a plurality of physical velocities of material in the plurality of annular segments;

c) a computing device for computing a plurality of material volumetric flow rates using the plurality of distances and the plurality of physical velocities; and d) a summing or integrating device for summing the plurality of volumetric flow rates to create a total volumetric flow rate of material past the point or points in the annulus.

19. The apparatus of claim 18 wherein the one or more sensors for measuring a plurality of distances lies in a plane substantially perpendicular to the drill pipe.

20. The apparatus of claim 18 wherein the one or more sensors for measuring a plurality of distances between a drill pipe and borehole wall are acoustic sensors.

21. The apparatus of claim 18 further comprising means for measuring physical velocity of the material in or substantially near at least a substantial number of the segments.

22. The apparatus of claim 18 further comprising means for measuring temperature and annular fluid pressure in each segment, and means for calculating temperature- and pressure-corrected caliper or standoff distances using the measured temperature and annular fluid pressure in each segment.

* * * * *